US010094012B2

(12) United States Patent
Ishida et al.

(10) Patent No.: US 10,094,012 B2
(45) Date of Patent: Oct. 9, 2018

(54) NI-IR-BASED HEAT-RESISTANT ALLOY AND PROCESS FOR PRODUCING SAME

(71) Applicant: TANAKA KIKINZOKU KOGYO K.K., Tokyo (JP)

(72) Inventors: Kiyohito Ishida, Sendai (JP); Toshihiro Omori, Sendai (JP); Yutaka Sato, Sendai (JP); Kunihiro Tanaka, Hiratsuka (JP); Muneki Nakamura, Hiratsuka (JP); Koichi Sakairi, Hiratsuka (JP); Tatsuya Nakazawa, Hiratsuka (JP)

(73) Assignee: TANAKA KIKINZOKU KOGYO K.K., Tokyo (JP)

( * ) Notice: Subject to any disclaimer, the term of this patent is extended or adjusted under 35 U.S.C. 154(b) by 269 days.

(21) Appl. No.: 15/127,348

(22) PCT Filed: Mar. 23, 2015

(86) PCT No.: PCT/JP2015/058785
§ 371 (c)(1),
(2) Date: Sep. 19, 2016

(87) PCT Pub. No.: WO2015/146931
PCT Pub. Date: Oct. 1, 2015

(65) Prior Publication Data

US 2017/0130310 A1 May 11, 2017

(30) Foreign Application Priority Data

Mar. 28, 2014 (JP) ..... 2014-67445

(51) Int. Cl.

| | |
|---|---|
| ***C22C 19/05*** | (2006.01) |
| ***C22C 5/04*** | (2006.01) |
| ***C22C 30/00*** | (2006.01) |
| ***C22F 1/00*** | (2006.01) |
| ***C22F 1/10*** | (2006.01) |
| ***C22C 19/03*** | (2006.01) |

(52) U.S. Cl.
CPC ..... *C22F 1/10* (2013.01); *C22C 19/03* (2013.01); *C22C 19/055* (2013.01); *C22C 19/056* (2013.01); *C22C 30/00* (2013.01)

(58) Field of Classification Search
CPC ..... C22F 1/10; C22C 10/03; C22C 10/056; C22C 10/055
See application file for complete search history.

(56) References Cited

U.S. PATENT DOCUMENTS

| | | | | |
|---|---|---|---|---|
| 7,666,352 | B2 * | 2/2010 | Ishida | C22C 5/04 148/430 |
| 2008/0206090 | A1 * | 8/2008 | Ishida | C22C 5/04 420/461 |
| 2013/0095346 | A1 * | 4/2013 | Wu | C22C 19/03 428/680 |
| 2016/0040276 | A1 * | 2/2016 | Ishida | C22C 19/03 148/707 |

FOREIGN PATENT DOCUMENTS

| | | | |
|---|---|---|---|
| EP | 1026269 | A1 | 8/2000 |
| EP | 1983067 | A1 | 10/2008 |
| JP | 2001294959 | A | 10/2001 |
| JP | 2010132966 | A | 6/2010 |
| WO | WO 2004/007782 | A1 | 1/2004 |
| WO | WO 2014/142089 | * | 9/2014 |

OTHER PUBLICATIONS

EP, Supplementary Search Report for European application No. 15768897.9, dated Oct. 27, 2017.
C. Zhang et al., Modeling of phase stability of the fcc phases in the Ni-Ir-Al system using the cluster/site approximation method coupling with first principles calculations. Acta Materialia, 2008 vol. 56, pp. 2576-2584.

* cited by examiner

*Primary Examiner* — C Melissa Koslow
(74) *Attorney, Agent, or Firm* — Orrick, Herrington & Sutcliffe LLP; Joseph A. Calvaruso

(57) ABSTRACT

The present invention relates to a NiIr-base heat-resistant alloy which includes a Ni—Ir—Al—W-base alloy which contains Ir: 5.0 to 50.0 mass %, Al: 1.0 to 8.0 mass %, W: 5.0 to 20.0 mass %, and the balance is Ni, and a γ' phase having an $L1_2$ structure precipitating and dispersing in a matrix as an essential strengthening phase, and a ratio (Y/X) of a peak intensity (Y) of (201) plane of the $Ir_3W$ phase observed in the range of 2θ=48° to 50° to a peak intensity (X) of (111) plane of the γ' phase observed in the range of 2θ=43° to 45° in X-ray diffraction analysis is 0.5 or less. The alloy exhibits good high-temperature property stably.

19 Claims, 4 Drawing Sheets

Example 1

Thickness of arm: Approx. 5 μm

Comparative example 1

Thickness of arm: Approx. 25 μm

Example 1

Comparative example 1

Example 1

Comparative example

NI-IR-BASED HEAT-RESISTANT ALLOY AND PROCESS FOR PRODUCING SAME

TECHNICAL FIELD

The present invention relates to a Ni-base heat-resistant alloy including a Ni—Ir—Al—W-base alloy, and a method of producing the same. Specifically, the present invention relates to a NiIr-base heat-resistant alloy having a high strength and abrasion resistance even during exposure to a severe usage environment, and to the method of producing the same.

BACKGROUND ART

Conventionally various kinds of high-temperature heat-resistant alloys such as a Ni-base alloy, a Co-base alloy and an Ir-base alloy have been known as a constituent material of a high-temperature member such as a jet engine and a gas turbine, or a tool for friction-stirring welding (FSW) and the like. For example, as a new substitute heat-resistant alloy for the Ni-base alloy, there has been disclosed an Ir—Al—W-base alloy of the Ir-base alloy (Patent Literature 1).

The present applicant has developed, as a heat-resistant alloy having novel composition, a heat-resistant alloy which is based on a Ni—Ir—Al—W-base alloy. This NiIr-base heat-resistant alloy is an alloy having essential additive elements of Ir, Al, and W added to Ni, including Ir: 5.0 to 50.0 mass %, Al: 1.0 to 8.0 mass %, W: 5.0 to 20.0 mass %, and a balance being Ni.

The aforementioned novel NiIr-base heat-resistant alloy utilises a precipitation strengthening action of a γ' phase ($(Ni, Ir)_3(Al, W)$) which is an intermetallic compound having an $L1_2$ structure as a strengthening mechanism. Since the γ' phase exhibits reverse temperature dependence such that strength increases with rising in temperature, the γ' phase can impart excellent high-temperature strength and high-temperature creep properties to the alloy. Though the use of the strengthening action of the γ' phase is similar to the strengthening mechanism in the conventional Ni-base heat-resistant alloy, the NiIr-base heat-resistant alloy by the applicants is improved in the phenomenon of the γ' phase under high temperature, and has a better high-temperature stability than the Ni-base heat-resistant alloy.

Incidentally, for a production of an alloy, in general, the production includes steps for producing an alloy ingot of desired composition by a melting and casting method as a main step, and optional additional processing and heat treatment steps to produce an alloy product. The NiIr-base heat-resistant alloy by the applicant can be produced by the general melting and casting method, and further an aging heat treatment is conducted for precipitating the γ' phase which is the main strengthening mechanism. The aging heat treatment may preferably be conducted by heating at a temperature in the temperature range of 700 to 1300° C. for 0.5 minutes to 72 hours.

CITATION LIST

Patent Literature

Patent Literature 1: Japanese Patent No. 4833227

SUMMARY OF INVENTION

Technical Problem

By the applicants, it has been confirmed that the aforementioned NiIr-base heat-resistant alloy can inhibit the generation of the third phase (B2 phase) which is a factor of embrittlement by adjusting its composition into the appropriate range to exhibit an excellent strength and abrasion resistance under high temperature. However, with respect to products made of several test alloys, unexpected abrasion has been observed. Such a poor property in the NiIr-base heat-resistant alloy does not always happen, but should be avoided.

In the present invention, the factor of the poor property which is generated accidentally in the NiIr-base heat-resistant alloy by the applicants is made clear to prepare an alloy which ensures strength, hardness and abrasion resistance under high temperature. And further, a method where the NiIr-base heat-resistant alloy may be produced stably is disclosed.

Solution to Problem

First, in order to solve the above problems, the present inventors have studied the factors which causes the above poor property in the NiIr-base heat-resistant alloy of the inventors. As a result, it has been found that the material which generates high-temperature abrasion has a different phase constitution of alloy from that of the material having no trouble. Explaining in detail, in the NiIr-base heat-resistant alloy, as mentioned above, though the γ' phase ($(Ni, Ir)_3(Al, W)$) is a main phase to ensure the strength under high temperature, it has been found that there is a case where the $Ir_3W$ phase is precipitated depending on production conditions of the alloy, and such an alloy has a poor high-temperature property. The present inventors have arrived at the present invention by considering the influence of the $Ir_3W$ phase and controlling the precipitating amount to obtain a NiIr-base heat-resistant alloy having the preferred high-temperature property.

The present invention relates to a NiIr-base heat-resistant alloy including a Ni—Ir—Al—W-base alloy which contains Ir: 5.0 to 50.0 mass %, Al: 1.0 to 8.0 mass %, W: 5.0 to 20.0 mass %, and the balance being Ni, and a γ' phase having an $L1_2$ structure precipitating and dispersing in a matrix as an essential strengthening phase, and a ratio (Y/X) of a peak intensity (Y) of (201) plane of the $Ir_3W$ phase observed in the range of $2\theta=48°$ to 50° to a peak intensity (X) of (111) plane of the γ' phase observed in the range of $2\theta=43°$ to 45° in X-ray diffraction analysis is 0.5 or less.

As mentioned above, the heat-resistant alloy according to the present invention is an alloy which is based on the NiIr-base heat-resistant alloy including the Ni—Ir—Al—W-base alloy, and is specified by the amount of $Ir_3W$ phase which is assumed to be the factor of decreasing in properties. In the following, the present invention is explained in detail.

The present heat-resistant alloy has Ni, Ir, Al, and W as essential constituent elements. Al as an additive element is a main constituent element of the γ' phase and a component essential to precipitation of the γ' phase. When the content of Al is less than 1.0 mass %, no γ' phase precipitates, or even when precipitates, the precipitation does not reach a state possible to contribute to the improvement in high-temperature strength. On the other hand, the ratio of the γ' phase increases with an increase of Al concentration, but when Al is excessively added, the ratio of a B2-type intermetallic compound (NiAl, hereinafter may be referred to as a B2 phase) increases to make the alloy brittle and decrease the strength of the alloy. Accordingly, the upper limit of Al amount is set to 8.0 mass %. Note that Al also contributes to the improvement in oxidation resistance of the alloy. The amount of Al is preferably from 1.9 to 6.1 mass %.

W is a component of the NiIr-base alloy which contributes to the stabilization of the γ' phase at high temperature, and is a main constituent element. The stabilization of the γ' phase by the addition of W has not been known in the conventional NiIr-base alloy, but by the present inventors, the addition of W can raise a γ' phase solid solution temperature and can ensure the stability at high temperature. When W is added in an amount of less than 5.0 mass %, the improvement in high-temperature stability of the γ' phase is not sufficient. On the other hand, excessive addition of W in an amount exceeding 20.0 mass % facilitates the formation of a phase mainly composed of W having a large specific gravity and segregation is likely to occur. Note that W also has an action of solid-solution strengthening of an alloy matrix. The amount of W is preferably from 10.0 to 20.0 mass %.

Then, Ir is an additive element which dissolves in the matrix (γ phase) in the form of a solid solution and is partially substituted by Ni of the γ' phase, to raise a solidus temperature and a solid solution temperature of the y phase and the γ' phase, respectively, and to improve heat resistance. Ir exhibits an addition effect in an amount of 5.0 mass % or more, but excessive addition of Ir increases the specific gravity of the alloy and the solidus temperature of the alloy also becomes high temperature. Accordingly, the upper limit of Ir is set to 50.0 mass %. The amount of Ir is preferably from 10.0 to 45.0 mass %.

Moreover, in the Ni-base heat-resistant alloy according to the present invention, additional additive elements may be added in order to further improve high-temperature properties of the alloy or to improve additional properties. Examples of such additional additive elements include B, Co, Cr, Ta, Nb, Ti, V, and Mo.

B is an alloy component that segregates at a crystal grain boundary to strengthen the grain boundary, and contributes to improvement in high-temperature strength and ductility. The addition effect of B becomes significant in an amount of 0.001 mass % or more, but excessive addition of B is not preferable for processability and thus the upper limit of B is set to 0.1 mass %. The amount of B to be added is preferably from 0.005 to 0.02 mass %.

Co is effective for increasing the ratio of the γ' phase to raise strength. Co is partially substituted by Ni of the γ' phase to be a constituent element of the phase. Such an effect appears when 5.0 mass % or more of Co is added, but excessive addition of Co decreases the solid solution temperature of the γ' phase and impairs high-temperature properties. For this reason, the upper limit of Co content is preferably set to 20.0 mass %. Note that Co also has an action of improving abrasion resistance.

Cr is also effective for strengthening grain boundaries. Moreover, when C is added to the alloy, Cr forms carbides to precipitate the carbides in the vicinity of the grain boundaries, to strengthen the grain boundaries. The addition effect of Cr appears in an amount of 1.0 mass % or more. However, when Cr is excessively added, the melting point of the alloy and the solid solution temperature of the γ' phase are lowered and high-temperature properties are impaired. For this reason, the amount of Cr to be added is preferably set to 25.0 mass % or less. Note that Cr also has an action of forming a dense oxide film on the surface of the alloy and improving oxidation resistance.

Ta stabilizes the γ' phase and is also an element effective for improvement in high-temperature strength of the γ phase by solid-solution strengthening. Moreover, when C is added to the alloy, Ta can form and precipitate carbides and thus is an additive element effective for strengthening the grain boundaries. When added in an amount of 1.0 mass % or more, Ta exhibits the aforementioned action. Moreover, since excessive addition causes formation of a harmful phase or decreasing in the melting point, the upper limit of Ta is preferably 10.0 mass %.

Moreover, Nb, Ti, V, and Mo are also additive elements effective for stabilization of the γ' phase and improvement in high-temperature strength by solid-solution strengthening of a matrix. Nb, Ti, V, and Mo are preferably added in an amount of 1.0 to 5.0 mass %.

As mentioned above, additive elements of B, Co, Cr, Ta, Nb, Ti, V, and Mo can segregate in the vicinity of the grain boundary to improve grain-boundary strength while they improve strength by stabilizing the γ' phase. As mentioned above, Co, Cr, Ta, Nb, Ti, V, and Mo also act as constituent elements of the γ' phase. A crystal structure of the γ' phase in this case is an $L1_2$ structure similar to the γ' phase of a Ni—Ir—Al—W quaternary alloy without additive elements and is expressed as $(Ni, X)_3(Al, W, Z)$. Here, X is Ir or Co, and Z is Ta, Cr, Nb, Ti, V, or Mo.

Then, an example of a further effective additive element includes C. C forms carbides together with metal elements in the alloy to precipitate the carbides to improve high-temperature strength and ductility. Such an effect appears when 0.001 mass % or more of C is added, but since excessive addition of C is not preferable for processability or toughness, the upper limit of C content is set to 0.5 mass %. The amount of C to be added is preferably set to 0.01 to 0.2 mass %. Note that C has a great significance for the formation of the carbides as mentioned above, and in addition, is an element effective for strengthening of the grain boundaries by segregation, similar to that of B.

Note that similar properties can be obtained by substituting Ir of the alloy with a precious metal element other than the aforementioned various additive elements. Specifically, even when Ir contained in the alloy in an amount of 5.0 to 50.0 is partially substituted with 30 mass % or less of Rh or Pt, the strengthening mechanism by the γ' phase can be exhibited.

The present invention allows the concentration of each alloy element to be adjusted within the aforementioned range, and the γ' phase which acts as a strengthening phase under high temperature to be precipitated. Here, explaining the phase construction of the alloy according to the present invention, the γ' phase which is the main strengthening phase is $(Ni, Ir)_3(Al, W)$. The precipitation strengthening action by the γ' phase is similar to that in the conventional Ni-base alloy or Ir-base alloy. Since the γ' phase has the reverse temperature dependence of the strength, the high-temperature stability is good. Moreover, in the present invention, since the high-temperature stability of the γ' phase is improved more, and in addition to this, the alloy itself (γ phase) has high high-temperature strength, the alloy maintains excellent high-temperature property in comparison with the conventional Ni-base heat-resistant alloy even when exposed to higher temperature atmosphere. Note that a particle size of the γ' phase in the Ni-base heat-resistant alloy according to the present invention is preferably 10 nm to 1 μm. The precipitation strengthening action can be obtained in the precipitates of 10 nm or more, but rather decreases in coarse precipitates of more than 1 μm.

Then, the present invention controls the precipitation amount of the $Ir_3W$ phase which is considered to affect high-temperature properties of the alloy. Specifically, the ratio (Y/X) of the peak intensity (Y) of (201) plane of the $Ir_3W$ phase to the peak intensity (X) of (111) plane of the γ' phase is made 0.5 or less. The present invention is based on the results of the X-ray diffraction analysis because the analysis shows a relatively appropriate result at the definition of the phase construction while the analysis method is relatively easy. In the NiIr-base alloy according to the present invention, the γ' phase has the strongest peak of (111) plane which is observed in the range of 2θ=43° to 45°. The $Ir_3W$ phase has the strongest peak of (201) plane and is observed in the range of 2θ=48° to 50°. By the present inventors, when the peak intensity ratio (Y/X) of these phases is more than 0.5, it is confirmed that the alloy has low strength. The peak intensity ratio (Y/X) is preferably 0.1 or less, most preferably 0.

The NiIr-base alloy according to the present invention can improve high-temperature strength by appropriate dispersion of the γ' phase, but the formation of the other phases except the $Ir_3W$ phase is not eliminated. Namely, when adding Al, W, and Ir within the aforementioned ranges, there may be a case where not only the γ' phase but also the B2 phase may be precipitated depending on composition. Further, in the Ni—Al—W—Ir quaternary alloy, there is also a possibility to precipitate the ε' phase of D019 structure. In the NiIr-base alloy according to the present invention, high-temperature strength can be ensured even when those precipitates other than the γ' phase are present. Of course, in the NiIr-base alloy according to the present invention, the precipitation of the B2 phase is relatively inhibited. Further, the NiIr-base alloy according to the present invention can stably exhibit a high hardness of 550 to 700 Hv (at normal temperature).

Next, the method of producing the NiIr-base alloy according to the present invention is explained. The method of producing the NiIr-base alloy according to the present invention is basically similar to general production methods of alloys, and includes mainly steps for producing an alloy ingot having aforementioned composition by a melting and casting method, and a step for subjecting the alloy to an aging heat treatment.

As mentioned above, since the NiIr-base alloy according to the present invention requires that the precipitation amount of the $Ir_3W$ phase should be a certain amount or less in the material structure, the production conditions to consider those requests are set. Here, as to the reason why the $Ir_3W$ phase is generated, the present inventors have assumed that the production steps, that is, the growing mechanism of the cast structure (dendrite structure) which relates to a cooling rate particularly in the melting and casting step is the reason. The dendrite structure which is a structure so called as dendritic crystal commonly found in the general melting and casting step, is composed of a stem part (a first arm) of a main axis and branched parts (a second arm and a third arm) formed from the stem part. In the dendrite structure with the form, the first arm is formed and grown to some extent, and next the second arm is formed and grown, and then the third arm is formed in the order. The microscopic form of the dendrite structure varies with the cooling rate. Namely, when the cooling rate is fast, the first arm is formed and grown rapidly, thereby the second and third arms are formed almost at the same time as the formation of the first arm, and thus, a dense structure will be presented where the fine first arm and the second and third arms are gathered. On the other hand, when the cooling rate is slow, it takes a long time for the first arm to be formed and grown, and then the casting (solidification) is finished when the second arm is not fully formed, and thus, the thick first arm and the ungrown second arm are formed. At that time, the region between the dendrite structures is formed from solidifying the molten solution with time difference, the structural unevenness is easy to be generated.

The present inventors have thought that it would not be possible to precipitate the γ' phase sufficiently even if they carry out the aging heat treatment later for precipitating the γ' phase in the region where composition is uneven as mentioned above as to the alloy after casting, and the undesirable precipitating phase such as $Ir_3W$ phase may be formed. Though there may also happen this unevenness of composition in the region between the dendrite structures in the other alloy systems, it is assumed that, in case of the NiIr-base heat-resistant alloy of the present invention, since the alloy is the quaternary (or more elements-base) alloy containing a plurality of alloy elements, and contains Ir of a super high melting point metal to Al of a low melting point metal, it is not possible to control the behavior at solidification completely, and thus the influence due to the thickness of the dendrite first arm is larger.

Accordingly, for the sake of producing the NiIr-base alloy having a small amount of $Ir_3W$ phase according to the present invention, it is necessary to obtain the dense structure where the fine first arm and the second and third arms are gathered in the casting stage. Namely, it is very important to optimize the cooling condition in the casting step. Specifically, the cooling rate in the casting step is 200° C./min or more. When the cooling rate is less than 200° C./min, because of too slow cooling, the growth of the first arm having a thick stem is mainly proceeded and thus the formation of the second and third arms cannot be accelerated, which results in increasing of precipitation amount of the $Ir_3W$ phase due to the unevenness of composition. Note that the upper limit of the cooling rate is not set in view of inhibiting the precipitation of the $Ir_3W$ phase. However, since the too high cooling rate gives unsuitable solidification stress to cause crack, it is preferably 500° C./min or less. Note that the more preferable cooling rate is 300° C./min or more.

The cooling rate in the casting step can be controlled, for example by using a material having a high thermal conductivity (copper, silver, aluminum, etc.) as a constituent material of a die, and cooling the die appropriately. Since the NiIr-base alloy according to the present invention is good in casting property and is resistant to cracking at the solidification, the alloy ingot can also be produced in the form near the final shape of the product in the casting step (near net shape manufacturing). Accordingly, by selecting the constituent materials of the die and optimizing the shape and size of the die, it is possible to produce an alloy product efficiently.

In addition, the method of producing the NiIr-base alloy according to the present invention includes essentially the aging heat treatment step after the melting and casting step. This is to precipitate the γ' phase of the strengthening factor of the alloy by the aging heat treatment. This aging heat treatment may be conducted in the temperature range of 700 to 1300° C. Preferably, the temperature range is 750 to 1200° C. In addition, the heating period of time in this step is preferably from 30 minutes to 72 hours. Note that this heat treatment may be performed several times, for example, in a manner of heating for 4 hours at 1100° C. and further heating for 24 hours at 900° C.

Here, in the aging heat treatment step, it is preferable to control the cooling temperature after heating and maintaining at the above temperature in order to precipitate the fine γ' phase and to prevent the material from cracking. When the cooling rate is too fast, there is a possibility that a coarse γ' phase is precipitated to affect high-temperature strength of the alloy. Further, there is a fear that the γ' phase cracks by heat shock, thus there is a risk that cracking occurs in the alloy due to the too fast cooling rate. The cooling rate after the aging heat treatment is preferably 5 to 80° C./sec.

The NiIr-base alloy where the γ' phase is dispersed in the γ phase may be produced by the aging heat treatment. Note that, during the melting and casting step to the aging heat treatment step, the processing step such as forging, or the heat treatment may be carried out. Particularly, prior to the aging heat treatment, a heat treatment for homogenization may also be carried out. In this homogenization heat treatment, the alloy to be produced by various methods is heated to the temperature range of 1100 to 1800° C. Preferably, the alloy is heated in the range of 1200 to 1600° C. The heating period of time in this step is preferably from 30 minutes to 72 hours.

Further, after the aging heat treatment, a processing treatment such as rolling or machining may be carried out optionally depending on the product shape. As mentioned above, since the NiIr-base alloy can be casted in the manner of the near net shape manufacturing, it is possible to obtain the final shape by a simple processing after the casting step and the aging heat treatment step.

Advantageous Effects of Invention

The NiIr-base alloy according to the present invention can exhibit inherent properties such as high-temperature strength and abrasion resistance stably. The NiIr-base alloy can be produced by setting the cooling rate in the melting and casting step appropriately, and moreover, by adjusting the cooling rate after the aging heat treatment together, it is possible to produce an alloy having the improved high-temperature property.

BRIEF DESCRIPTION OF DRAWINGS

FIG. 5 shows the results of the X-ray diffraction analysis of each alloy of

EXAMPLE 1 AND COMPARATIVE EXAMPLE 1.

DESCRIPTION OF EMBODIMENTS

In the following, preferred examples of the present invention are explained,

First embodiment: In this embodiment, a NiIr-base heat-resistant alloy including 37.77 mass % Ni—25.0 mass % Ir—4.38 mass % Al—14.32 mass % W—7.65 mass % Co—4.67 mass % Ta—6.1 mass % Cr—0.1 mass % C—0.01 mass % B was produced, and the alloy was processed into an FSW tool to be carried out the welding test, and then the abrasion resistance of the alloy was evaluated.

The NiIr-base heat resistant alloy was produced by preparing an alloy molten solution by an arc melting under an inert gas atmosphere, and casting into a die under an atmospheric circumstance to be cooled and solidified in the melting and casting step. In the embodiment, two dies were used, one being a die made of copper and having a profile which was corresponding to that of the FSW tool of the final product, and the other being a die made of ceramics used for a lost wax method. The sizes of the dies were the same. The cooling rates of these dies were 450° C./min for the copper die, and 20° C./min for the ceramics die.

The alloy ingot produced by the melting and casting step was subjected to the heat treatment for homogenization under the conditions at 1300° C. for 4 hours, and then after heating for a given period of time the ingot was cooled. At the period, the cooling was carried out by air cooling at a rate of 30° C./sec. The aging heat treatment was carried out under the condition of maintaining for 24 hours at a temperature of 800° C., and then after heating for a given period of time the ingot was cooled slowly. After cooling, a convex FSW tool (dimension: pin length 1.7 mm, shoulder diameter φ 15 mm) was produced by machining.

The welding test by using the produced FSW tool was conducted by preparing a pair of welding member (SUS304) to be welded which was processed to a given shape, butting the both to contact the FSW tools with each other, rotating the tools to heat the contact part by friction, and then welded. The welding conditions at the case were in the followings.

Tool insert angle: 3°
Insert depth: 1.80 mm/sec
Tool rotation rate: 150 rpm or 200 rpm
Welding rate: 1.00 mm/sec
Shielding gas: argon
Welding length per one pass: 250 mm Evaluation of the abrasion was achieved by measuring the sectional dimension of the recovered welded tool after one pass, and measuring an abrasion amount (abrasion volume) at the most abrased portion.

Figure 1:
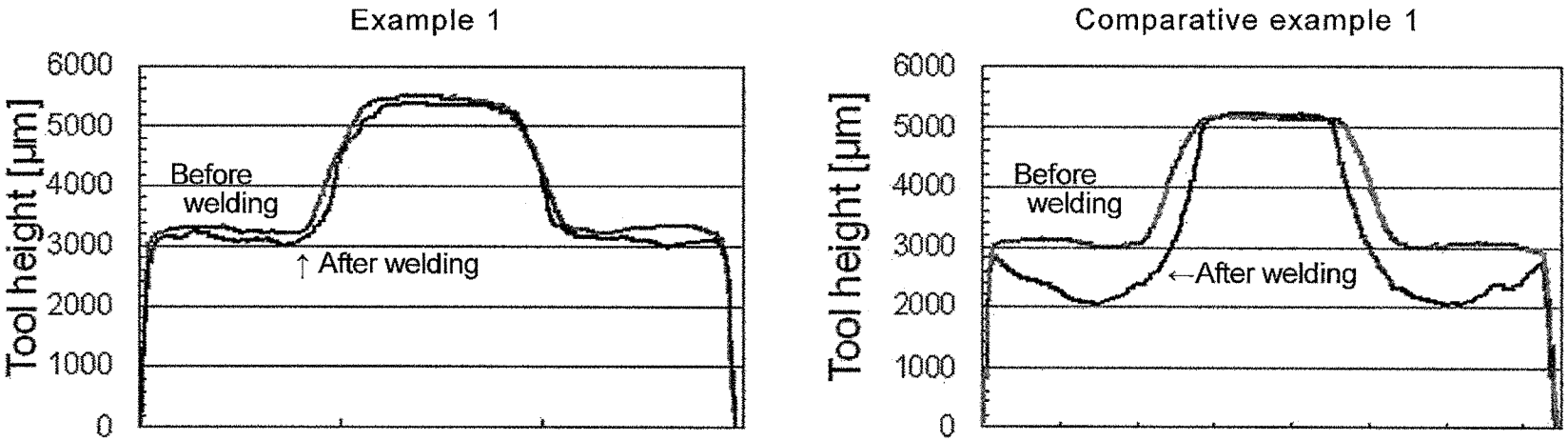
FIG. 1 shows the measured results of the tool sizes after welding test with the FSW tools made from the alloys according to Example 1 and Comparative Example 1.
Figure 2:
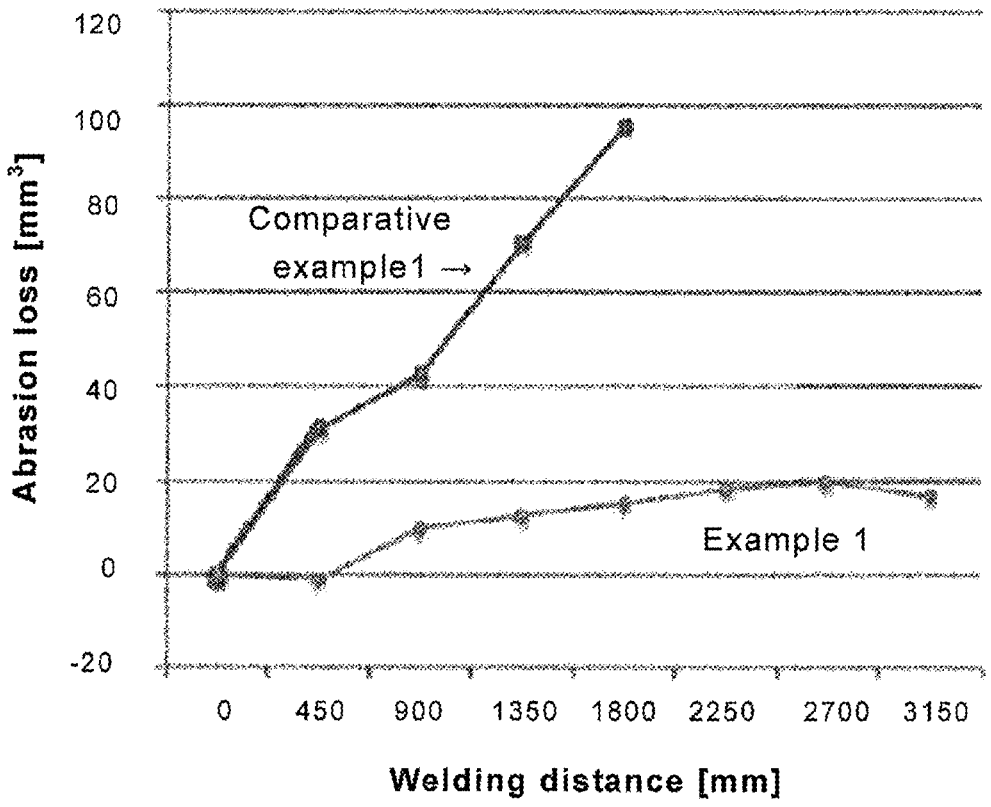
FIG. 2 is a graph showing the change of abrasion amounts relative to the welding length in the welding test.

The measured results are shown in FIG. 1, and with respect to the tool of the Comparative Example 1, a severe abrasion is observed at its shoulder portion after the welding. In contrast, with respect to the tool of Example 1, a slight abrasion is observed at its shoulder portion similar to Comparative Example 1, but is extremely minor. FIG. 2 shows the change of abrasion amount relative to the welding length. In Comparative Example 1, the abrasion amount is considerably increased with the increase of welding length. In contrast, in Example 1, the influence of the increase of the welding length is minor, and the abrasion amount is approximately 115 of that of the Comparative Example at the welding length of 1800 mm (the fourth pass).

Figure 3:
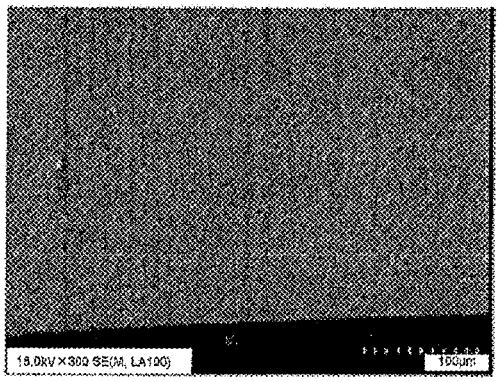
FIG. 3 shows photographs of the material structures of the alloys of Example 1 and Comparative Example 1 after the melting and casting.
Figure 3:
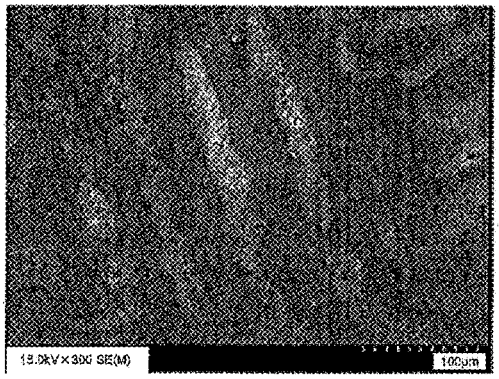
Figure 4:
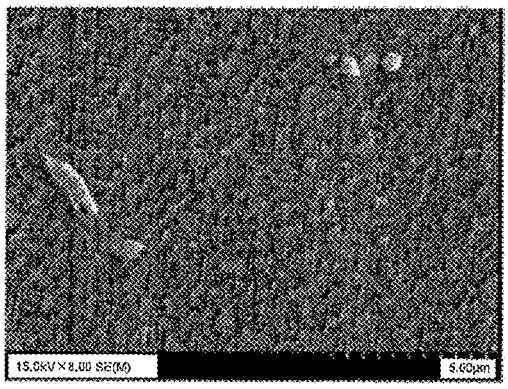
FIG. 4 shows photographs of the material structures of Example 1 and Comparative Example 1 after the aging heat treatment.
Figure 4:
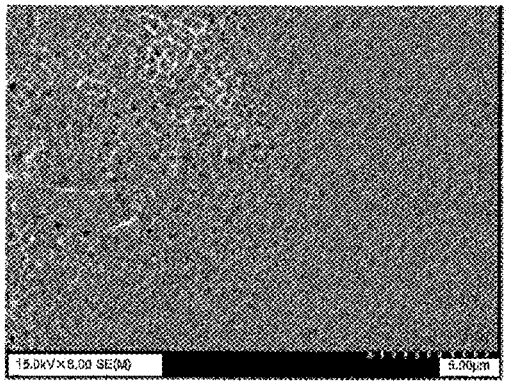

Here, the differences between Example 1 and Comparative Example 1 are studied. FIG. 3 shows the material structures of Example 1 and Comparative Example 1 after the melting and casting. Out of these photographs, the alloy ingot of Example 1 shows the structure where the first arm and the second arm of the dendrite are gathered finely. In contrast, with respect to Comparative Example 1, though a thick stem of the first arm can be observed, the second arm is not grown enough, and other solidified phases are observed between the dendrites. Moreover, FIG. 4 shows the material structures of Example 1 and Comparative Example 1 after the aging heat treatment, and though the precipitation of the γ' phase may be found in both materials, there may be observed regions of a poor precipitation in Comparative Example.

Figure 5:
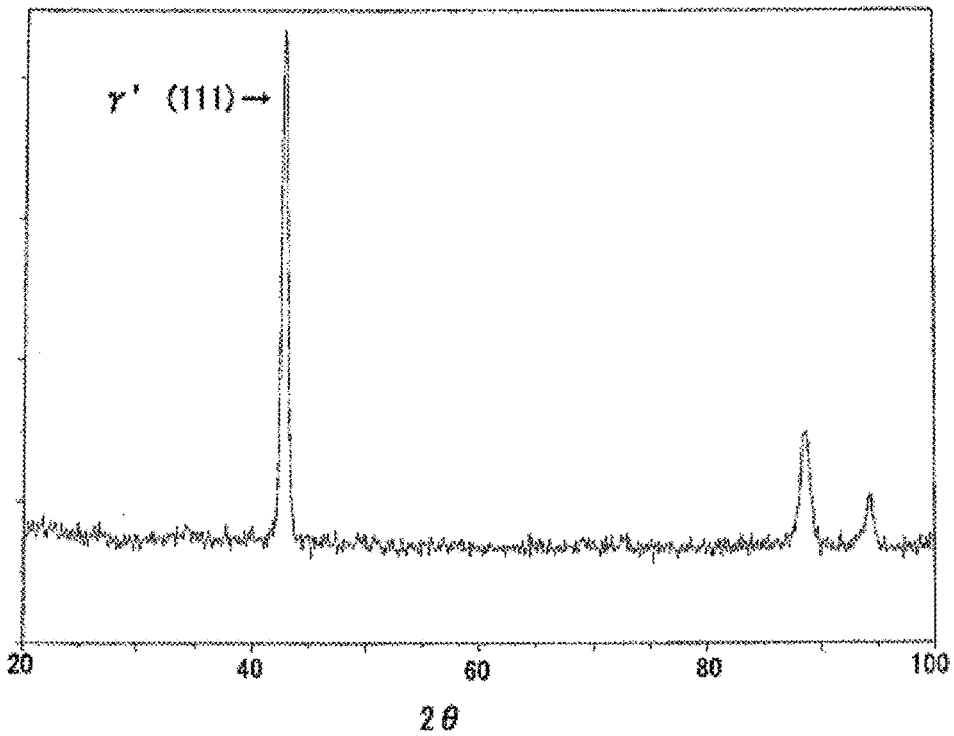
Figure 5:
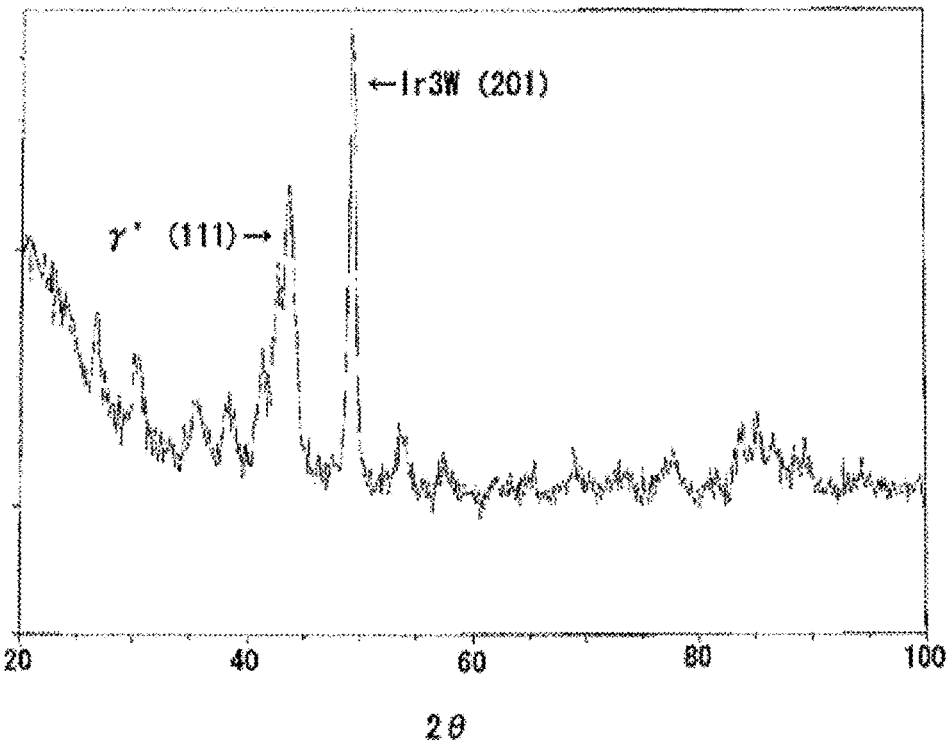

FIG. 5 shows the results of the X-ray diffraction analysis of each alloy of Example 1 and Comparative Example 1. This X-ray diffraction analysis was conducted under the analytical conditions (45 kV, 40 mA, Cu-Kα ray). From the figure, in the alloy of Comparative Example 1, a relatively strong peak was observed at the range of 2θ=48° to 50°, which is considered to be the peak of the (201) plane of the $Ir_3W$ phase. For this peak intensity (Y), when a ratio (Y/X) where the peak intensity (X) is observed in the range of 2θ=43° to 45° of the (111) plane of the γ' phase, is calculated, the solution was 1.4. In contrast, the peak of the (201) plane of the $Ir_3W$ phase in the alloy of Example 1 is extremely weak, it is difficult to separate from noise. Therefore, the peak intensity ratio (Y/X) of Example 1 is considered to be 0.1 or less. Thus, the phase structures of Example 1 and Comparative Example are quite different, and Comparative Example 1 shows a poor abrasion resistance under high temperature.

Second Embodiment: Here, the NiIr-base heat-resistant alloy having the same composition as that in the first embodiment by changing the cooling rate and varying the material of the die were produced, and then the phase structures and the metal structures were compared. In the embodiment, a carbon die and an iron die (Comparative Example 2 and Comparative Example 3) were used as the die. They have the same profile and dimension. In addition, copper dies (Example 2 and Comparative Example 4) having the different dimension from that in the first embodiment were also used.

In the production steps of the alloy of the embodiment, the similar conditions to the first embodiment were employed except that only the cooling rate was changed by varying the kind of the die. After the production of the alloy, the X-ray diffraction analysis was conducted to calculate the peak intensity ratio, and then a compression strength test at 1000° C. was conducted. The calculated peak intensity ratios (Y/X) and the results of the compression strength test at 1000° C. are shown in Table 1. Note that, in Example 1 and Comparative Example 1 of the first embodiment, the compression strength test at 1000° C. was conducted, and the results being shown in Table 1 together.

TABLE 1

| | Die | Cooling rate | Y/X | Compression strength test |
|---|---|---|---|---|
| Example 1 | Copper | 450° C./min | 0.1 or less | 863 MPa |
| Example 2 | Copper | 300° C./min | 0.4 | 714 Mpa |
| Comparative Example 1 | Ceramics | 20° C./min | 1.4 | 629 Mpa |
| Comparative Example 2 | Carbon | 80° C./min | 1.5 | 633 Mpa |
| Comparative Example 3 | Iron | 100° C./min | 1.2 | 651 Mpa |
| Comparative Example 4 | Copper | 200° C./min | 0.8 | 682 MPa |

With respect to Comparative Examples 2 to 4 where the cooling rate is slow, the peaks due to the $Ir_3W$ phase appear with difference in strength, and the peak intensity ratio is more than 0.5. Therefore, these alloys are inferior in the compression strength at 1000° C. It can be confirmed that it is necessary to make the cooling rate fast while casting as in Examples 1 and 2. Besides, as is seen in Comparative Example 4, even when the copper die is used, there may be a case where the $Ir_3W$ phase is slightly precipitated, and thus it is necessary to set the cooling rate due to appropriate thermal capacity calculation or the like in addition to the selection of material of the die.

INDUSTRIAL APPLICABILITY

The present invention relates to the NiIr-base alloy which can exhibit high-temperature strength, oxidation resistance, and abrasion resistance stably. The present invention is suitable for members of a gas turbine, an aircraft engine, a chemical plant, an automobile engine such as a turbocharger rotor, and a high-temperature furnace and the like. Moreover, an example of application of the heat-resistant alloy includes application to a tool for friction-stirring welding (FSW) in recent years. The friction-stirring welding is a welding method of pressing the tool between members to be welded and moving the tool in a welding direction with rotating the tool at a high speed. This welding method allows to weld the members by frictional heat between the tool and the members to be welded and solid-phase stirring, and the temperature of the tool considerably increases. The conventional NiIr-base alloy can be applied to the welding of a relatively low melting point metal such as aluminum, but could not be used for a high melting point material such as a steel material, a titanium alloy, a nickel-base alloy, a zirconium-base alloy and the like from the viewpoint of the high-temperature strength. The NiIr-base alloy according to the present invention can be applied as a constituent material of a tool for friction-stirring welding, which is used to weld the aforementioned high melting point material, because of the improvement of the high-temperature strength.

The invention claimed is:

1. A NiIr-base heat-resistant alloy comprising a Ni—Ir—Al—W-base alloy which contains Ir: 5.0 to 50.0 mass %, Al: 1.0 to 8.0 mass %, W: 5.0 to 20.0 mass %, and the balance being Ni, and a γ' phase as an essential strengthening phase having an $L1_2$ structure precipitated and dispersed in a matrix, wherein a ratio (Y/X) of a peak intensity (Y) of (201) plane of the $Ir_3W$ phase observed in the range of 2θ=48° to 50° to a peak intensity (X) of (111) plane of the γ' phase observed in the range of 2θ=43° to 45° in X-ray diffraction analysis is 0.5 or less.

2. The NiIr-base heat-resistant alloy according to claim 1, comprising one or two or more additive elements selected from the following Group I:

Group I:

B: 0.001 to 0.1 mass %,

Co: 5.0 to 20.0 mass %,

Cr: 1.0 to 25.0 mass %,

Ta: 1.0 to 10.0 mass %,

Nb: 1.0 to 5.0 mass %,

Ti: 1.0 to 5.0 mass %,

V: 1.0 to 5.0 mass %, and

Mo: 1.0 to 5.0 mass %.

3. The NiIr-base heat-resistant alloy according to claim 1, further containing 0.001 to 0.5 mass % of C and carbides being precipitated and dispersed.

4. The NiIr-base heat-resistant alloy according to claim 1, wherein Ir in the alloy is substituted by Rh or Pt in an amount of 30 mass % or less.

5. The NiIr-base heat-resistant alloy according to claim 2, further containing 0.001 to 0.5 mass % of C and carbides being precipitated and dispersed.

6. The NiIr-base heat-resistant alloy according to claim 2, wherein Ir in the alloy is substituted by Rh or Pt in an amount of 30 mass % or less.

7. The NiIr-base heat-resistant alloy according to claim 3, wherein Ir in the alloy is substituted by Rh or Pt in an amount of 30 mass % or less.

8. A method of producing a NiIr-base heat-resistant alloy, comprising:

melting and casting for producing an alloy ingot having the composition according to claim 1 by a melting and casting method and subjecting the alloy ingot to an aging heat treatment in a temperature range of 700 to 1300° C., wherein a cooling rate in the melting and casting is 200° C./min or more.

9. The method of producing a NiIr-base heat-resistant alloy according to claim 8, wherein the aging heat treatment is carried out by heating the alloy in the temperature range of 700 to 1300° C., and then cooling at a cooling rate of 5 to 80° C./sec.

10. The method of producing a NiIr-base heat-resistant alloy according to claim 8, wherein the NiIr-base alloy is subjected to a homogenization heat treatment in a temperature range of 1100 to 1800° C., prior to the aging heat treatment.

11. A method of producing a NiIr-base heat-resistant alloy, comprising:

melting and casting for producing an alloy ingot having the composition according to claim 2 by a melting and casting method and subjecting the alloy ingot to an aging heat treatment in a temperature range of 700 to 1300° C., wherein a cooling rate in the melting and casting is 200° C./min or more.

12. The method of producing a NiIr-base heat-resistant alloy according to claim 11, wherein the aging heat treatment is carried out by heating the alloy in the temperature range of 700 to 1300° C., and then cooling at a cooling rate of 5 to 80° C./sec.

13. The method of producing a NiIr-base heat-resistant alloy according to claim 11, wherein the NiIr-base alloy is subjected to a homogenization heat treatment in a temperature range of 1100 to 1800° C., prior to the aging heat treatment.

14. A method of producing a NiIr-base heat-resistant alloy, comprising:

melting and casting for producing an alloy ingot having the composition according to claim 3 by a melting and casting method and subjecting the alloy ingot to an aging heat treatment in a temperature range of 700 to 1300° C., wherein a cooling rate in the melting and casting is 200° C./min or more.

15. The method of producing a NiIr-base heat-resistant alloy according to claim 14, wherein the aging heat treatment is carried out by heating the alloy in the temperature range of 700 to 1300° C., and then cooling at a cooling rate of 5 to 80° C./sec.

16. The method of producing a NiIr-base heat-resistant alloy according to claim 14, wherein the NiIr-base alloy is subjected to a homogenization heat treatment in a temperature range of 1100 to 1800° C., prior to the aging heat treatment.

17. A method of producing a NiIr-base heat-resistant alloy, comprising:

melting and casting for producing an alloy ingot having the composition according to claim 4 by a melting and casting method and subjecting the alloy ingot to an aging heat treatment in a temperature range of 700 to 1300° C., wherein a cooling rate in the melting and casting is 200° C./min or more.

18. The method of producing a NiIr-base heat-resistant alloy according to claim 17, wherein the aging heat treatment is carried out by heating the alloy in the temperature range of 700 to 1300° C., and then cooling at a cooling rate of 5 to 80° C./sec.

19. The method of producing a NiIr-base heat-resistant alloy according to claim 17, wherein the NiIr-base alloy is subjected to a homogenization heat treatment in a temperature range of 1100 to 1800° C., prior to the aging heat treatment.

* * * * *